US007090100B2

(12) United States Patent
Redlin

(10) Patent No.: US 7,090,100 B2
(45) Date of Patent: Aug. 15, 2006

(54) INFLATABLE BODY FOR PRESSING SHIRT-LIKE ITEMS OF CLOTHING, AND APPARATUS FOR PRESSING ITEMS OF CLOTHING WITH SUCH AN INFLATABLE BODY

(75) Inventor: Kathrin Redlin, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/849,676

(22) Filed: May 20, 2004

(65) Prior Publication Data

US 2004/0245295 A1 Dec. 9, 2004

Related U.S. Application Data

(63) Continuation of application No. PCT/EP02/12336, filed on Nov. 5, 2002.

(30) Foreign Application Priority Data

Nov. 20, 2001 (DE) ..... 101 56 858

(51) Int. Cl.
*A41H 5/02* (2006.01)

(52) U.S. Cl. ..... 223/67

(58) Field of Classification Search ..... 223/66, 223/67, 68, 72

See application file for complete search history.

(56) References Cited

U.S. PATENT DOCUMENTS

| | | | | |
|---|---|---|---|---|
| 245,361 | A * | 8/1881 | Eavestaff | 223/67 |
| 2,284,232 | A | 5/1942 | Richa | |
| 2,317,924 | A * | 4/1943 | Lendle | 223/67 |
| 3,165,244 | A * | 1/1965 | Dosal | 223/67 |
| 3,298,578 | A | 1/1967 | Shields | |
| 3,315,853 | A | 4/1967 | Blevens et al. | |

FOREIGN PATENT DOCUMENTS

| | | |
|---|---|---|
| GB | 848993 | 9/1960 |

* cited by examiner

*Primary Examiner*—Gary L. Welch
(74) *Attorney, Agent, or Firm*—John T. Winburn; Russell W. Warnock; Craig J. Loest

(57) ABSTRACT

Shirt-like garments can be stretched from the inside and pressed with an inflatable body that has a trunk part and two sleeve segments by inflating the inflatable body. Since the sleeves of the garments have different cross sections, deformation of the trunk section can take place in the area of the connecting points between the trunk section and the sleeve segments when the sleeves are small. On the other hand, if the sleeves are large, insufficient tensioning the sleeve segments can occur, thereby leading to bad pressing results. In order to be able to press a wider range of different cross sections of sleeves, the cross section of the sleeve segments is smaller in the connecting points than in the area adjacent the connecting points. Advantageously, the sleeve segments expand beyond the connecting points to their maximum cross section within a very small area.

17 Claims, 2 Drawing Sheets

INFLATABLE BODY FOR PRESSING SHIRT-LIKE ITEMS OF CLOTHING, AND APPARATUS FOR PRESSING ITEMS OF CLOTHING WITH SUCH AN INFLATABLE BODY

CROSS-REFERENCE TO RELATED APPLICATION

This application is a continuation, under 35 U.S.C. § 120, of copending international application No. PCT/EP02/12336, filed Nov. 5, 2002, which designated the United States; this application also claims the priority, under 35 U.S.C. § 119, of German patent application No. 101 56 858.4, filed Nov. 20, 2001; the prior applications are herewith incorporated by reference in their entirety.

BACKGROUND OF THE INVENTION

FIELD OF THE INVENTION

The present invention relates to an inflatable body for pressing shirt-like items of clothing. The inflatable body is patterned after a shirt and has a trunk section and two sleeve sections. The sleeve sections are connected to the trunk section at two connecting locations of the inflatable body. The invention also pertains to an apparatus for pressing shirt-like items of clothing with such an inflatable body.

For the purpose of pressing items of clothing, it is has been known in the art to tension the latter from the inside using an inflatable body in order to remove creases in the item of clothing. It is advantageous here if the item of clothing is tensioned in its own shape and without any creasing. This can be achieved, in particular, by the inflatable body having the same shape as the item of clothing which is to be pressed. For this purpose, in the case of shirt-like items of clothing, use is made of a shirt-like inflatable body, or of an inflatable body in the form of the upper part of the human body, which has a trunk section and two sleeve sections connected laterally thereto. Such an inflatable body can be used to press all items of clothing, with and without sleeves, which are intended for the upper part of the body. These may be, in particular, shirts with short or long sleeves, jackets, T-shirts, or pullovers.

In order to be suitable for different dimensions of the items of clothing which are to be pressed, the inflatable body is designed, at the relevant locations, to be large enough to be able to tension even items of clothing with the largest expected dimensions. There is the problem here, in the case of items of clothing with sleeves, that the sleeves may have very different diameters and the diameters can change to a considerable extent along the sleeves. In order for it also to be possible to press sleeves of different thicknesses, the sleeve sections of the inflatable body have to have a very large cross section. However, during the operation of pressing items of clothing with sleeves with a small cross section, this disadvantageously results in the situation where, at the connecting locations at which the sleeve sections are connected to the trunk section, the sleeve sections are constricted to a pronounced extent and form creases since they are connected there to the trunk section.

SUMMARY OF THE INVENTION

It is accordingly an object of the invention to provide an inflatable body and an apparatus for pressing shirt-like articles of clothing with an inflatable body which overcomes the above-mentioned disadvantages of the heretofore-known devices and methods of this general type and is enabled to press items of clothing with sleeves of different cross sections without any creasing.

With the foregoing and other objects in view there is provided, in accordance with the invention, an inflatable body for pressing shirt-like items of clothing, comprising:

a trunk section and two sleeve sections together forming the inflatable body with a shirt-like form;

each of the sleeve sections being connected to the trunk section at a respective connecting location of the inflatable body; and the sleeve sections having a given cross section at the connecting location smaller than a cross section of the sleeve sections in a vicinity of the connecting location.

Using sleeve sections of which the cross sections at the connecting locations are smaller than in a region in the vicinity of the connecting locations makes it possible to achieve the situation where, during the operation of pressing items of clothing with sleeves with small cross sections, the sleeve sections are not constricted at the connecting locations and thus do not develop any creases. The following increase in the cross section of the sleeve sections ensures that even sleeves with a large cross section are tensioned sufficiently in order to be pressed. It is thus possible, on the one hand, to avoid creases in the region of the connecting locations between the sleeve sections and the trunk sections and, on the other hand, to provide a sufficient tensioning region for tensioning sleeves even with a large cross section.

The sleeve sections thus advantageously have, at the connecting locations, a cross section which is not significantly larger than the smallest cross section which can be found in the region between the trunk and sleeve, or at the start of the sleeve, in the items of clothing which are to be pressed. The cross sections of the rest of the regions of the sleeve sections of the inflatable body can be dimensioned to be large enough for it to be possible for even items of clothing with wide sleeves to be tensioned from the inside.

The cross section of the sleeve sections advantageously increases very quickly, or within a very short distance of the sleeve sections, starting from the connecting locations. It is thus possible for the sleeves of the item of clothing which is to be pressed to be tensioned and pressed even at a very short distance from the transition location to the trunk. In particular, the inflatable body may be configured such that the cross section of the sleeve sections widens to the maximum cross section immediately following the connecting locations, with the result that a gap is produced between the sleeve sections and the trunk section, this gap preferably being completely closed when the inflatable body is inflated. This makes it possible to achieve the situation where the sleeve sections of the inflatable body can develop, over their entire length, a tensioning force for opening out sleeves which is directed perpendicularly to the longitudinal axis, and nevertheless the action of limiting the inflation of the sleeve sections in the vicinity of the connecting locations by items of clothing with narrow sleeves does not result in deformation in the inflatable body in the region of the connecting locations or in creases in the sleeves which are to be pressed.

In the case of the sleeve sections being widened within a very short distance, this results in those regions of the sleeve sections which are widened to a very pronounced extent butting against the trunk section when the inflatable body is inflated. This may be used in order to force the sleeve sections specifically in a certain direction. For this purpose, the inflatable body may be configured such that the regions of the sleeve sections butt against the trunk section when the inflatable body is inflated, and a compressive force is produced between these abutting regions of the sleeve sections and the corresponding regions of the truck section. Furthermore, those regions wherein the surface of the sleeve sections butt against the trunk section must not be rotationally symmetrical, with this resulting, in a region of the connecting location, in a predominant force which forces the sleeve sections in one direction.

Those regions wherein parts of the sleeve sections butt against the trunk section are preferably arranged here such that, in the operating position of the inflatable body, they are located in the bottom region of the connecting locations, with the result that the sleeve sections are forced upward in the operating position of the inflatable body. This force can be used in order retain the sleeve sections, together with sleeves of items of clothing pulled onto the same, in a certain angled position in the upward direction, counter to gravitational force, and to prevent them from inflecting downward, the trunk section being positioned vertically. The pressing result can thus be improved since items of clothing with sleeves are usually cut such that the sleeves project laterally away from the trunk section of the item of clothing. For example, the sleeves may project at an angle of approximately 60°.

The force between the trunk section of the inflatable body and the sleeve sections is determined here by the configuration of the inflatable body and the pressure at which the inflatable body is inflated. It may be possible here to change the pressure at which the inflatable body is inflated, in the case of an apparatus according to the invention for pressing shirt-like items of clothing, with the result that the inflating pressure can be used to adjust the force by which the sleeve section is deflected, in order to achieve, as far as possible, a crease-free tensioning of the items of clothing, depending on the cut of the latter.

In order to produce, and if appropriate to influence, a force between those parts of the sleeve sections and of the trunk section which butt against one another in a certain region, it is possible to use the configuration both of the sleeve sections and of the trunk section in this region. For example, those parts of the sleeve sections which butt against the trunk section may be configured such that, when inflated, they can curve outward and can press against the trunk section. It is likewise conceivable for the parts of the trunk section in this region to be of outwardly curving configuration such that, when inflated, they curve outward and press against the sleeve sections.

The cross section of the sleeve sections advantageously increases, starting from the connecting locations, essentially in the direction of that end of the trunk section which is located opposite the end with the connecting locations. This means that the shoulder regions of the inflatable body have a smooth profile and the widening of the sleeve sections is located on the underside thereof. The shirt can thus be pressed better in the important shoulder area.

Other features which are considered as characteristic for the invention are set forth in the appended claims.

Although the invention is illustrated and described herein as embodied in an inflatable body for pressing shirt-like items of clothing, and apparatus for pressing items of clothing with such an inflatable body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
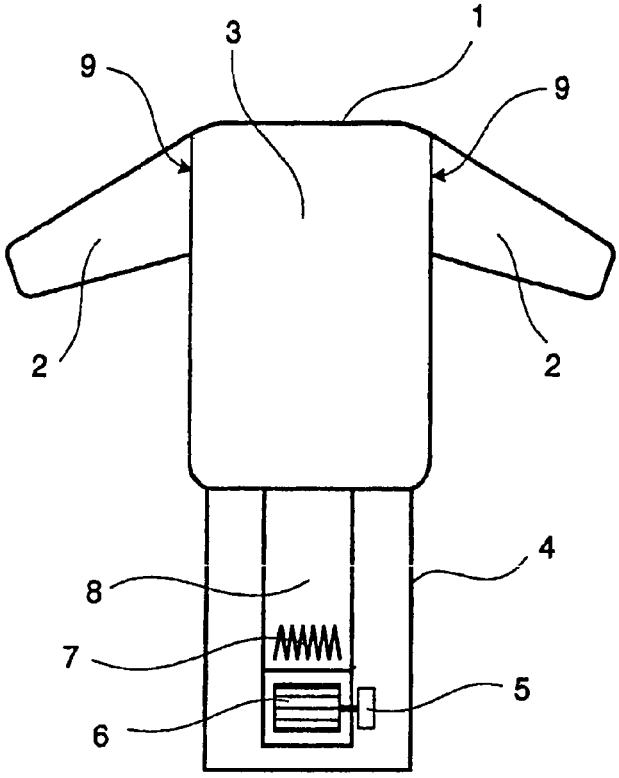
FIG. 1 is a schematic front view of an apparatus according to the invention for pressing shirt-like items of clothing with an inflatable body.

Referring now to the figures of the drawing in detail and first, particularly, to FIG. 1 thereof, there is shown an apparatus for pressing shirt-like items of clothing (shirts, jackets, blouses, pullovers, etc.). The apparatus has a bottom part 4 with an inflatable body 1 fastened thereon. The inflatable body 1 is shirt-like and has a trunk section 3 and two sleeve sections 2. The two sleeve sections 2 are each fastened on one side, at the top end of the trunk section 3, at connecting locations 9 which, in the case of a shirt, correspond to the shoulder areas, the trunk section 3 being connected to the sleeve sections 2 such that air can flow into the sleeve sections 2 from the interior of the trunk section 3. The inflatable body 1 consists of a non-rigid and air-permeable material. In addition, it is also possible for the inflatable body 1 to be formed of air-impermeable material, alternatively, partly of air-impermeable material and partly of air-permeable material.

The bottom part 4 has, in its interior, a fan 6 which is driven by a motor 5 and of which the output is connected to the inflatable body 1 within the bottom part 4 by way of an air channel 8. With the aid of the fan 6, air can be blown into the inflatable body 1 in order to generate a positive pressure therein and/or to inflate it. Since the inflatable body 1 consists of an air-permeable material, air can escape out of it. During operation of the fan 6, an equilibrium is thus established at a pressure at which the air fed into the inflatable body 1 by the fan 6 escapes through the enclosure of the inflatable body 1. The air channel 8 contains an electric heater 7 by way of which the air fed into the inflatable body 1 by the fan 6 can be heated.

Figure 2C:
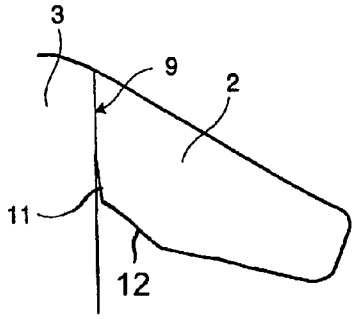
FIGS. 2B and 2C are similar views of alternative embodiments of the sleeve section.
Figure 2A:
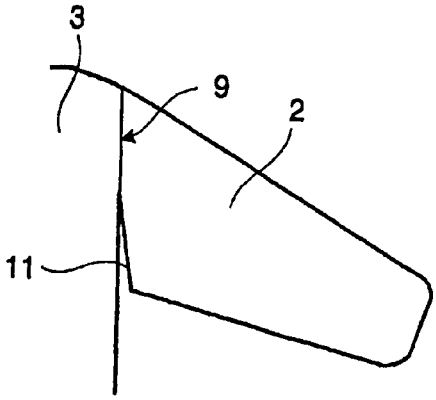
FIG. 2A is an enlarged front view of part of the inflatable body with part of the trunk section and a sleeve section.
Figure 2B:
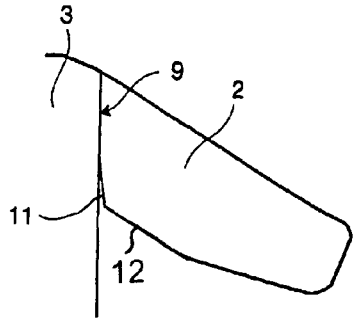

FIGS. 2A, 2B, and 2C illustrate a shoulder of the inflatable body 1 with the sleeve section 2 fastened on the shoulder. The trunk section 3 and the sleeve section 2 have been forced some way apart from one another at the bottom. The connection between the trunk section 3 and the sleeve section 2 along the connecting location 9 does not extend over the entire height of that section of the sleeve section 2 which follows the connecting location 9. Furthermore, the trunk section 3 is connected to the sleeve sections 2 such that the connecting location 9 is located in the top region of the abutment surface between the trunk section 3 and the sleeve section 2. The inflatable body 1 here is configured such that the top part of the essentially tubular sleeve section 2 extends outward, and in the process slopes down slightly, from the connecting location 9. In contrast, the bottom part of the sleeve section 2 runs vertically downward, in the first instance, from the connecting location 9, in order then likewise to extend outward with a small amount of inclination. The cross section of the sleeve section 2 becomes smaller in the outward direction since the sleeves of items of clothing usually likewise have a decreasing cross section in the outward direction. The trunk section 3 is thus connected to the sleeve section 2 at the abutment location not over the entire surface over which the trunk section 3 and the sleeve section 2 are in contact, but only in a top part, along the connecting location 9.

This configuration of the connection between the sleeve sections 2 and the trunk section 3 results in the inflatable body 1 having an outline in the form of a shirt, although the trunk section 3 is not connected to the sleeve sections 2 in the bottom abutment region. This means that even a shirt with very small sleeves can be pulled on without the trunk section 3, together with the sleeve sections 2, deforming such that the shirt creases. In the case of the sleeve which has been pulled on having a small cross section or a small cross-sectional surface area, the bottom regions of the sleeve sections 2 can be forced upward alongside the connecting locations 9 without this resulting in deformation of the trunk section 3, since the bottom regions of the sleeve sections 2 can slide along the trunk section 3. At the same time, the sleeve is tensioned uniformly by the sleeve sections 2, with the result that the shirt, including the sleeves, can be tensioned, and thus pressed, without creases.

Beneath the connecting location 9 the end surfaces of the sleeve sections 2 each have a curved surface 11 which, although butting against the trunk section 3, is not connected to the latter. The curved surface 11 is configured such that it curves outward in the downward direction when the inflatable body 1 is inflated. The curved surface 11 thus produces a force which is directed against the side of the trunk section 3. The sleeve sections 2 thus press against the trunk section 3 at the bottom and generate a torque, which forces the outer ends of the sleeve sections 2 upward. If the sleeve of a shirt which has been pulled on is not small enough for the sleeve sections 2 at the connecting locations 9 to be fully compressed as far as the connecting locations 9, at least parts of the curved surfaces 11 remain, it being possible for these to press against the trunk section 3 and thus to force the sleeve sections 2 upward in the outward direction. In the case of larger and thus heavier sleeves, the remaining part of the curved surfaces 11 is advantageously larger, this also resulting in a larger force by means of which the sleeve sections 2 can be forced upward in the outward direction.

In the modification of the sleeve section illustrated in FIG. 2B, the widened segment, i.e., the thickening, is followed by a segment 12 with a constant sleeve diameter, which is in turn followed by a taper segment that tapers towards the free end of the sleeve section 2. In the modification illustrated in FIG. 2C, the intermediate segment of the sleeve section has an increasing diameter, i.e., it increases in diameter up to the following taper that once more decreases towards the free end of the sleeve section 2.

FIGS. 3A, 3B and 4A, 4B illustrate two embodiments of the connecting locations 9. Illustrations are given here in each case of that part of the trunk section 3 which follows the connecting location 9 and of that end surface of a sleeve section 2 which follows the connecting location 9, the trunk section 3 and the sleeve section 2 having been separated along the connecting location 9.

Figure 3A:
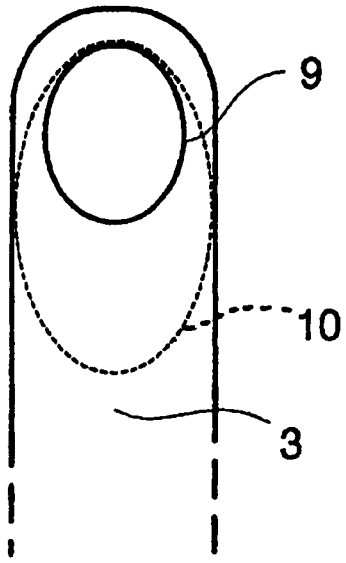
FIG. 3A is an elevational view of a side of the trunk section at a connecting location to the sleeve section according to a first exemplary embodiment.
Figure 3B:
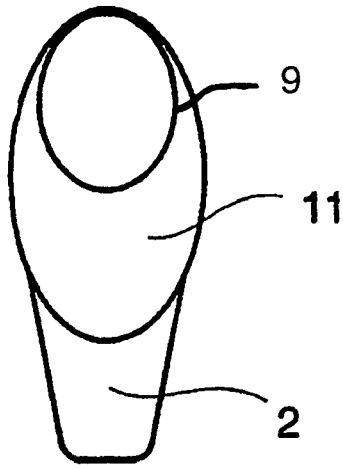
FIG. 3B is an elevational view of an end of a sleeve section according to the first exemplary embodiment at a connecting location of the sleeve to the trunk section.

FIGS. 3A and 3B illustrate a first embodiment for the connecting location 9, wherein the trunk section 3 and the sleeve sections 2 are connected to one another along a vertically oriented ellipse or an oblong rounded shape. The curved surface 11 of the end side of the sleeve section 2 which is located outside this ellipse is configured such that it curves outward only in the bottom region. This form of connecting location 9 has the advantage that, even in the case of very small sleeves, the cross section of the compressed sleeve sections 2 at the connecting locations 9 remains essentially round or elliptical and can thus better correspond to the cross-sectional shape of the sleeves.

Figure 4A:
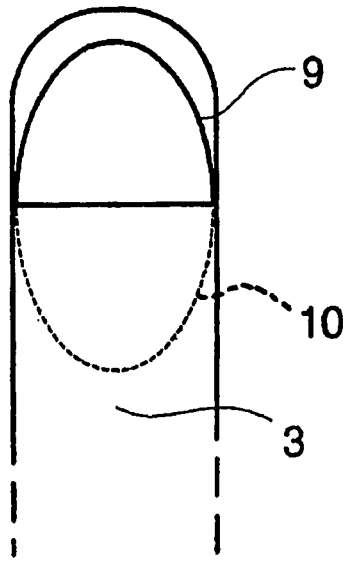
FIG. 4A is an elevational view of a side of the trunk section at a connecting location to the sleeve section according to a second exemplary embodiment.
Figure 4B:
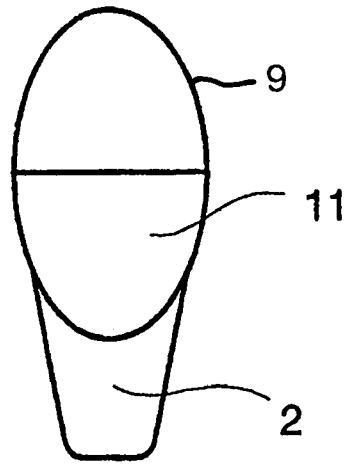
FIG. 4B is an elevational view of an end of a sleeve section according to the second exemplary embodiment at a connecting location of the sleeve to the trunk section.

In the case of the second embodiment for the connecting location 9, which is illustrated in FIGS. 4A and 4B, the trunk section 3 and the sleeve sections 2 are connected to one another along the top half of the elliptical cross section of the sleeve sections 2. This results, in this case, in the curved surface 11 being in the form of a half-ellipse. This embodiment has the advantage, in particular, that it is easy to produce.

For the purpose of pressing a shirt, the latter is pulled onto the inflatable body, preferably in the damp state, and fixed such that it cannot open at the front. This can take place either by virtue of the shirt being buttoned up or with the aid of a non-illustrated configuration for clamping and securing the button strip and the buttonhole strip. Air heated with the aid of the fan 6 and of the heater 7 is then blown into the inflatable body 1, which thus inflates. Additional information with regard to the structural features of the buttonhole strip clamp and similar information may be had from my copending patent applications PCT/EP02/12586 and PCT/EP02/12587, which are herewith incorporated by reference.

By virtue of being inflated, the inflatable body 1 positions itself against the inside of the shirt which is to be pressed, forces the material of the shirt outward and thus tensions the same. This tensioning operation causes the material of the shirt to be pressed. At the same time, the shirt is heated by the heated air which flows out of the inflatable body 1 from the inside, and moisture is withdrawn from the shirt. The pressing action of the tensioning operation is yet further enhanced by the heat. The shirt is preferably pulled onto the inflatable body 1 in the damp state, tensioned and dried under tensioning.

I claim:

1. An inflatable body for pressing shirt-like items of clothing, comprising:

a trunk section and two sleeve sections together forming the inflatable body with a shirt-like form;

each of said sleeve sections having an end portion being connected to said trunk section at a respective connecting location of the inflatable body;

said sleeve sections having a given cross section at said connecting location smaller than a cross section of said sleeve sections in a vicinity of said connecting location;

wherein the connection location permitting fluid flow between the trunk section and the respective sleeve sections does not extend over the entire height of the end portion; and a surface disposed on the end portion of each sleeve section below the connecting location and contacting the trunk section to press against the trunk section below the connecting location in an inflated state and generate a torque forcing the sleeve sections upwardly.

2. The inflatable body according to claim 1, wherein the cross sections of said sleeve sections increase, starting from said connecting locations, in a direction towards free ends of said sleeve sections within thickening segments of said sleeve sections, and said thickening segments are very short relative to a length of said sleeve sections.

3. The inflatable body according to claim 2, wherein said thickening segments are shorter than 0.1 times to 0.2 times the length of said sleeve sections.

4. The inflatable body according to claim 2, wherein said trunk section and said sleeve sections are formed of flexible material, and wherein, in an inflated state of the inflatable body, portions of said surfaces are curved surfaces bulging outwardly of said sleeve sections and butt against said trunk section.

5. The inflatable body according to claim 4, wherein said portions of said curved surfaces butting against said trunk section, are deformable in an outward direction such that, when the inflatable body is inflated, said portions exert a force against sides of said trunk section.

6. The inflatable body according to claim 4, wherein regions of said trunk section butting against said portions of said curved surfaces of said sleeve sections are deformable in an outward direction such that, when the inflatable body is inflated, regions exert a force against the abutting said portions of said sleeve sections.

7. The inflatable body according to claim 1, wherein said sleeve sections widen outwardly from said connecting locations, followed by tapering segments, wherein the cross section of the sleeve sections decreases in the direction towards free ends of said sleeve sections.

8. The inflatable body according to claim 7, wherein the cross section in said tapering segments decreases continuously to the free ends of said sleeve sections.

9. The inflatable body according to claim 7, wherein the inflatable body has regions of constant cross section between the tapering sections and said regions of said sleeve sections wherein the cross section is larger than at said connecting locations.

10. The inflatable body according to claim 1, wherein said regions of said sleeve sections wherein a cross section is larger than at said connecting locations are followed by thickening segments, wherein the cross section of said sleeve sections increases in a direction towards free ends of said sleeve sections.

11. The inflatable body according to claim 1, wherein said connecting locations are disposed at top ends of abutment surfaces between said trunk section and said sleeve sections.

12. The inflatable body according to claim 1, wherein a cross section of said sleeve sections at said connecting locations is not more than one half a maximum cross section of said sleeve sections.

13. The inflatable body according to claim 1, further comprising devices for inflating said inflatable body.

14. An inflatable body for pressing shirt-like items of clothing, comprising:

a trunk section;

a sleeve section connected to the trunk section extending outwardly from a first end panel disposed adjacent the trunk section to a second end disposed opposite the first end panel; and the first end panel having a connecting location defining an opening permitting air flow between the trunk section and the sleeve section, the connecting opening being smaller than the first end panel.

15. The inflatable body according to claim 1, wherein the first end panel includes an outer surface contacting the trunk section below the opening.

16. The inflatable body according to claim 1, wherein the outer surface includes a curved surface bulging outwardly toward the trunk section in an inflated state and applying a force on the trunk section.

17. The inflatable body according to claim 1, further comprising a fan and a heater for providing heated air to the inflatable body.

* * * * *